US007922308B2

(12) United States Patent
Wanibe et al.

(10) Patent No.: US 7,922,308 B2
(45) **Date of Patent: *Apr. 12, 2011**

(54) LIQUID DETECTION DEVICE, LIQUID CONTAINER USING THE SAME, AND METHOD OF PRODUCING LIQUID DETECTION DEVICE

(75) Inventors: Akihisa Wanibe, Matsumoto (JP); Yasuharu Godo, Shiojiri (JP); Takayuki Ayuzawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 217 days.

This patent is subject to a terminal disclaimer.

(21) Appl. No.: 12/058,646

(22) Filed: Mar. 28, 2008

(65) Prior Publication Data

US 2008/0238956 A1 Oct. 2, 2008

(30) Foreign Application Priority Data

Mar. 30, 2007 (JP) ..... 2007-092181
Sep. 28, 2007 (JP) ..... 2007-253419

(51) Int. Cl.
*B41J 2/175* (2006.01)

(52) U.S. Cl. ..... 347/86; 347/19

(58) Field of Classification Search ..... None
See application file for complete search history.

(56) References Cited

U.S. PATENT DOCUMENTS

| | | | | |
|---|---|---|---|---|
| 6,536,861 | B1 | 3/2003 | Usui et al. | |
| 7,448,717 | B2 | 11/2008 | Wanibe et al. | |
| 7,578,567 | B2 | 8/2009 | Zhang et al. | |
| 2006/0139393 | A1 * | 6/2006 | Zhang et al. | 347/19 |
| 2006/0251430 | A1 * | 11/2006 | Wanibe et al. | 399/1 |
| 2009/0174734 | A1 * | 7/2009 | Wanibe | 347/7 |

FOREIGN PATENT DOCUMENTS

| | | | |
|---|---|---|---|
| EP | 1 679 195 | A2 | 7/2006 |
| JP | 2001-146030 | A | 5/2001 |
| JP | 2001-328277 | A | 11/2001 |
| JP | 2006-281550 | A | 10/2006 |
| JP | 2006-315302 | A | 11/2006 |
| JP | 2006341599 | A | 12/2006 |
| JP | 2007-015408 | A | 1/2007 |

* cited by examiner

*Primary Examiner* — Matthew Luu
*Assistant Examiner* — Justin Seo
(74) *Attorney, Agent, or Firm* — Sughrue Mion, PLLC

(57) ABSTRACT

A liquid detection device includes a casing main body in which a passage is formed and exposed in an opening, a sensor base that is disposed to face the passage of the casing main body, a sensor chip provided on the sensor base, a film that seals the opening in which the sensor base is held, and a partition wall that divides the passage into an upstream side and an downstream side. The sensor chip has a sensor cavity, and the sensor base has a first hole that guides a liquid from the upstream side to the sensor cavity, and a second hole that guides the liquid from the sensor cavity to the downstream side. The sensor base can come into contact with the casing main body through only the partition wall in a depth direction of the opening.

18 Claims, 15 Drawing Sheets

LIQUID DETECTION DEVICE, LIQUID CONTAINER USING THE SAME, AND METHOD OF PRODUCING LIQUID DETECTION DEVICE

Japanese Patent Application No. 2007-92181 filed on Mar. 30, 2007 and Japanese Patent Application No. 2007-253419 filed on Sep. 28, 2007, are hereby incorporated by reference in their entirety.

BACKGROUND OF THE INVENTION

The present invention relates to a liquid detection device suitable for detecting the liquid (ink) level or the like in a liquid consumption device such as an inkjet recording device, a liquid container including the liquid detection device, a method of producing a liquid detection device, and the like.

As a typical example of a liquid consumption device, an inkjet recording device including an inkjet image recording head is known. Further examples of a liquid jet device include a device including a color material jet head used to produce a color filter for a liquid crystal display or the like, a device including an electrode material (conductive paste) jet head used to form an electrode for an organic EL display, a field emission display (FED), or the like, a device including a bio-organic substance jet head used to produce a bio-chip, a device including a sample jet head as a precision pipette, and the like.

In an inkjet recording device as a typical example of a liquid consumption device, an inkjet recording head which has a pressure generation means that pressurizes a pressure generation chamber and a nozzle opening which discharges a pressurized ink as an ink droplet is secured to a carriage. An ink contained in an ink container is successively supplied to the recording head through a passage so that successive printing can occur. The ink container is formed as a removable cartridge which can be easily exchanged by the user when the ink has been consumed, for example.

As a method of managing ink consumption of the ink cartridge, a method which manages (calculates) ink consumption by integrating the number of ink droplets discharged from the recording head or the amount of ink sucked up by maintenance by means of software, a method which manages the time when a specific amount of ink has been consumed by incorporating a liquid surface detection electrode in the ink cartridge, and the like have been known.

However, the method which manages ink consumption by integrating the number of ink droplets or the amount of ink by means of software has the following problem. Specifically, a head may have a variation in weight of ink droplets discharged. Such a variation in weight of ink droplets does not affect image quality. On the other hand, the ink cartridge is filled with an excess amount of ink taking into account the case where an ink consumption error is accumulated due to a variation. Therefore, the ink remains depending on the product.

According to the method which manages the time when a specific amount of ink has been consumed utilizing an electrode, since the actual amount of ink can be detected, the ink level can be managed with high reliability. However, since the liquid surface of the ink is detected utilizing the conductivity of the ink, the type of ink which can be detected is limited. Moreover, the electrode seal structure becomes complicated. Since a noble metal having high conductivity and corrosion resistance is generally used as the material for the electrode, the production cost of the ink cartridge increases. Furthermore, since it is necessary to provide two electrodes, the number of production steps increases, whereby the production cost increases.

A device developed to solve the above-mentioned problems is disclosed in JP-A-2001-146030 as a piezoelectric device (hereinafter referred to as "sensor unit"). This sensor unit monitors the ink level in an ink cartridge utilizing a phenomenon in which the resonance frequency of a residual vibration signal caused by residual vibrations (free vibrations) of a diaphragm after forced vibrations changes depending on whether or not ink exists in a sensor cavity opposite to the diaphragm on which a piezoelectric element is stacked.

JP-A-2006-281550 discloses technology in which a metal sensor base provided with a sensor chip including a piezoelectric element is disposed in an opening in a unit base and sealed with a film. The sensor base of the unit base is disposed to face an ink supply passage of an ink container. In this case, the unit base is liquid-tightly disposed in the ink container through a sealing rubber. In order to ensure liquid-tight properties using the sealing rubber, a spring which presses the unit base against the ink container side is provided.

FIG. 7 or 12 of JP-A-2006-315302 discloses a structure in which a sensor base is supported at three points (i.e., partition wall and right and left walls of a casing main body). JP-A-2001-328277 discloses technology in which a breakwater wall is provided in a liquid opposite to a sensor so that bubbles enter a sensor cavity to only a small extent even if bubbles occur on the liquid surface in a tank.

The technology disclosed in JP-A-2006-281550 can implement the detection principle disclosed in JP-A-2001-146030. However, it is necessary to provide the unit base separately from the ink container, and the sealing rubber and the spring are indispensable to liquid-tightly secure the unit base in the ink container.

Therefore, the technology disclosed in JP-A-2006-281550 increases the number of parts and complicates assembly for liquid-tightly securing the unit base using the sealing rubber.

Since the unit base is formed by double-molding polypropylene and an elastomer, cost increases.

According to the technology disclosed in JP-A-2006-315302, since vibrations of the piezoelectric element are absorbed by the casing main body that comes into contact with the sensor base at three points, it is difficult to obtain sufficient vibrations which can be detected by the piezoelectric element. Moreover, since the sensor base is positioned utilizing an opening formed in the casing main body, bubbles remain in a minute gap around the sensor base during ink injection, whereby an ink end state may be erroneously detected. This cannot be prevented even when using the breakwater wall disclosed in JP-A-2001-328277. Specifically, the breakwater wall blocks the flow of the ink when initially injecting the ink, whereby bubbles are likely to occur around the sensor base.

Some aspects of the invention may provide a liquid detection device which enables a reduction in the number of parts, a liquid container including the liquid detection device, and a method of producing a liquid detection device.

Other aspects of the invention may provide a liquid detection device which has a structure that can increase an amplitude during liquid detection, a liquid container including the liquid detection device, and a method of producing a liquid detection device.

Further aspects of the invention may provide a liquid detection device in which erroneous detection is suppressed by employing a structure which rarely allows bubbles to remain around a sensor base when introducing a liquid, a liquid container including the liquid detection device, and a method of producing a liquid detection device.

SUMMARY

According to one aspect of the invention, there is provided a liquid detection device comprising:

a casing main body, a passage being formed in the casing main body and exposed in an opening;

a sensor base that faces the passage in the opening formed in the casing main body;

a sensor chip that includes a piezoelectric element, the sensor chip being provided on the sensor base on a side that is opposite to a side that faces the passage;

a film that holds the sensor base in the opening and seals the opening; and a partition wall that divides the passage into an upstream side and an downstream side inside the casing main body, the sensor chip having a sensor cavity that receives a liquid that is a detection target;

the sensor base having a first hole that guides the liquid from the upstream side of the passage to the sensor cavity, and a second hole that guides the liquid from the sensor cavity to the downstream side of the passage; and the sensor base being able to come into contact with the casing main body through only the partition wall at a position between the first hole and the second hole in a depth direction of the opening.

According to another aspect of the invention, there is provided a liquid detection device comprising:

a casing main body, a passage being formed in the casing main body and exposed in an opening;

a sensor base that is faces the passage in the opening formed in the casing main body;

a sensor chip that includes a piezoelectric element, the sensor chip being provided on the sensor base on a side that is opposite to a side that faces the passage;

a film that holds the sensor base in the opening and seals the opening;

a passage wall that is provided to the casing main body and is opposite to the sensor base; and a partition wall that divides the passage into an upstream side and an downstream side inside the casing main body, the sensor chip having a sensor cavity that receives a liquid that is a detection target;

the sensor base having a first hole that guides the liquid from the upstream side of the passage to the sensor cavity, and a second hole that guides the liquid from the sensor cavity to the downstream side of the passage;

the partition wall being integrally formed to extend from one of the sensor base or the passage wall toward the other of the sensor base or the passage wall; and a gap being formed between the partition wall and the other of the sensor base or the passage wall, and a flow resistance of the gap being higher than a flow resistance of the first hole.

Another aspect of the invention defines a liquid container comprising the casing main body of the liquid detection device as a casing main body of the liquid container.

According to another aspect of the invention, there is provided a method of producing a liquid detection device comprising:

disposing a sensor base provided with a sensor chip that includes a piezoelectric element to face the passage in an opening formed in a casing main body provided with a passage; and welding a film around the opening to support the sensor base provided with the sensor chip by the casing main body through the film and seal the opening, the disposing step including supporting the sensor base by a partition wall that partitions the passage into an upstream side and a downstream side in the casing main body; and the disposing step and the welding step causing the sensor cavity that is formed in the sensor chip and receives a liquid that is a detection target to communicate with the upstream side of the passage through a first hole formed in the sensor base and communicate with the downstream side of the passage through a second hole formed in the sensor base to form a liquid detection path.

According to another aspect of the invention, there is provided a liquid detection device secured to a liquid container that includes a liquid supply port that supplies a liquid contained in the liquid container to the outside, the liquid detection device comprising:

a sensor chip; and a sensor base provided with the sensor chip, the sensor chip having a cavity that receives a liquid that is a detection target through an opening;

the sensor base including a supply path that supplies the liquid to the opening side of the cavity, and a discharge path that discharges the liquid from the opening side of the cavity;

the sensor chip including a diaphragm formed to be able to vibrate and face the cavity, the piezoelectric element being stacked on the diaphragm;

the liquid container including a passage forming section that communicates with the supply path and the discharge path of the liquid detection device; and the liquid detection device being supported on the liquid container by a partition wall and secured to the liquid container by a film, the partition wall dividing the passage forming section into a supply passage that supplies the liquid to the supply path and an introduction passage that introduces the liquid from the discharge path.

DETAILED DESCRIPTION OF THE EMBODIMENT

Figure 1:
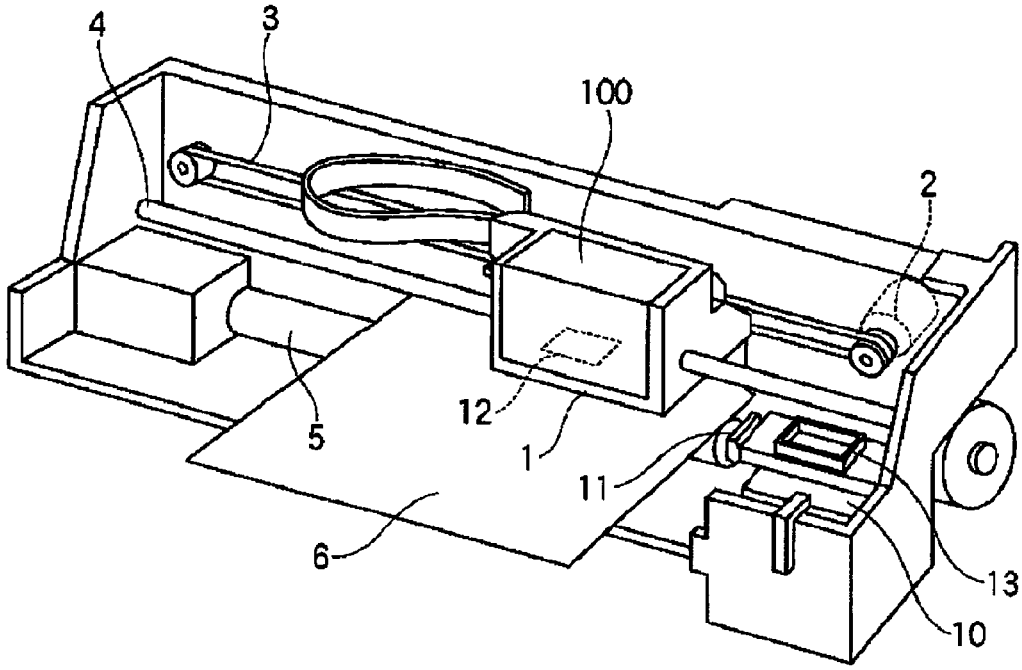
FIG. 1 is a schematic oblique view showing an inkjet printer as a liquid consumption device.

According to one embodiment of the invention, there is provided a liquid detection device comprising:

a casing main body, a passage being formed in the casing main body and exposed in an opening;

a sensor base that faces the passage in the opening formed in the casing main body;

a sensor chip that includes a piezoelectric element, the sensor chip being provided on the sensor base on a side that is opposite to a side that faces the passage;

a film that holds the sensor base in the opening and seals the opening; and a partition wall that divides the passage into an upstream side and an downstream side inside the casing main body, the sensor chip having a sensor cavity that receives a liquid that is a detection target;

the sensor base having a first hole that guides the liquid from the upstream side of the passage to the sensor cavity, and a second hole that guides the liquid from the sensor cavity to the downstream side of the passage; and the sensor base being able to come into contact with the casing main body through only the partition wall at a position between the first hole and the second hole in a depth direction of the opening.

According to this embodiment of the invention, when the piezoelectric element vibrates, the sensor base provided with the sensor chip including the piezoelectric element also vibrates. If the contact area between the sensor base and the casing main body is large, vibrations of the sensor base are absorbed by the casing main body. In this case, the residual vibration waveform does not have an amplitude sufficient for detection by the piezoelectric element. According to this embodiment of the invention, the sensor base can come into contact with the casing main body through only the partition wall in the depth direction of the opening. Therefore, vibrations absorbed by the casing main body are minimized, whereby an amplitude sufficient for detection by the piezoelectric element can be obtained. Moreover, since the sensor base can be supported by the partition wall when providing the sensor base in the opening, the sensor base can be prevented from deeply penetrating the opening.

In the liquid detection device according to this embodiment, the casing main body may include a passage wall at a position opposite to the sensor base; and the partition wall may be integrally formed with the passage wall of the casing main body and extending toward the sensor base. In this case, the partition wall can be integrally formed when molding the casing main body.

According to this embodiment of the invention, the casing main body may include an auxiliary support section that supports the sensor base at one or more positions other than the partition wall when providing the sensor base in the opening. Therefore, since the sensor base can be supported at least two points when providing the sensor base in the opening, the sensor base can be stably supported during assembly.

Note that the auxiliary support section is apart from (does not come into contact with) the sensor base when the sensor base is held by the film substantially in parallel with the passage wall. Therefore, the sensor base can come into contact with only the partition wall during detection by the piezoelectric element, whereby an amplitude sufficient for detection by the piezoelectric element can be obtained. The sensor base comes into contact with the auxiliary support section when an abnormality occurs due to an impact force (e.g., when the liquid detection device is dropped) so that inclination of the sensor base can be limited. This prevents a situation in which the sensor base breaks the film.

In order to achieve the above effects, a height from the passage wall to an end of the auxiliary support section may be set to be smaller than a height from the passage wall to an end of the partition wall.

According to this embodiment of the invention, the sensor base supported by the film need not be constantly in contact with the partition wall. A small opening may be formed between the sensor base supported by the film and the partition wall. In this case, a flow resistance of an opening between the sensor base and the partition wall integrally formed with the casing main body must be higher than a flow resistance of the first hole. This prevents a situation in which a liquid or bubbles pass from the upstream side to the downstream side through the opening, whereby the function of the partition wall can be ensured. It is preferable that the sensor base is not contact with the partition wall in order to increase the amplitude detected by the piezoelectric element.

In the liquid detection device according to this embodiment, an end of the partition wall may be formed to be thinner than a base portion of the partition wall, and the end of the partition wall may be positioned between the first hole and the second hole of the sensor base. This improves the moldability of the partition wall. Moreover, the first hole and the second hole can be prevented being closed by the partition wall.

According to this embodiment of the invention, the partition wall may be integrally formed with the sensor base between the first hole and the second hole. The auxiliary support section may be integrally formed with the sensor base. In this case, a height from the sensor base to an end of the auxiliary support section may be set to be smaller than a height from the sensor base to an end of the partition wall.

In the liquid detection device according to this embodiment, the sensor base may have a shape that has four sides that are respectively opposite to each other along two perpendicular axial directions; at least four positioning sections that protrude toward the four sides of the sensor base may be provided in at least the opening of the casing main body at positions opposite to the four sides of the sensor base; and an opening between a wall section that forms the opening and the four sides of the sensor base may form part of the upstream side or the downstream side of the passage in an area excluding the at least four positioning sections.

The sensor base is disposed in the opening in a state in which at least four sides of the sensor base are positioned using at least four positioning sections, and a gap formed in an area excluding the at least four positioning sections forms a liquid passage. This suppresses a situation in which bubbles remain around the sensor base, whereby the liquid is erroneously detected. A gap is also formed by the four positioning sections. However, the formation area of the gap is sufficiently small as compared with related art. Specifically, a space in which bubbles become larger is not formed.

Two of the at least four positioning sections are situated on an extension of the partition wall. This aims at causing the liquid to flow between the upstream side and the downstream side of the passage through only the sensor cavity.

It is preferable that one of the at least four positioning sections be longitudinally formed along one side (preferably long side) of the sensor base. This is effective for positioning of the sensor base in the rotation direction.

It is preferable that a supply port that supplies a liquid to the upstream side of the passage be disposed at a position that is not opposite to the first hole of the sensor base, and a discharge port that discharges a liquid from the downstream side of the passage may be disposed at a position that is not opposite to the second hole of the sensor base. Specifically, a liquid introduced through the supply port or discharged through the second hole of the sensor base collides against the sensor base or the wall which forms the passage and becomes dispersed so that the liquid easily enters the opening.

It is preferable that the supply port that supplies the liquid to the upstream side of the passage and the discharge port that discharges the liquid from the downstream side of the passage be disposed opposite to the opening in an area excluding the at least four positioning sections. Therefore, the liquid easily enters the above-described opening.

According to another embodiment of the invention, there is provided a liquid detection device comprising:

a casing main body, a passage being formed in the casing main body and exposed in an opening;

a sensor base that is faces the passage in the opening formed in the casing main body;

a sensor chip that includes a piezoelectric element, the sensor chip being provided on the sensor base on a side that is opposite to a side that faces the passage;

a film that holds the sensor base in the opening and seals the opening;

a passage wall that is provided to the casing main body and is opposite to the sensor base; and a partition wall that divides the passage into an upstream side and an downstream side inside the casing main body, the sensor chip having a sensor cavity that receives a liquid that is a detection target;

the sensor base having a first hole that guides the liquid from the upstream side of the passage to the sensor cavity, and a second hole that guides the liquid from the sensor cavity to the downstream side of the passage;

the partition wall being integrally formed to extend from one of the sensor base or the passage wall toward the other of the sensor base or the passage wall; and a gap being formed between the partition wall and the other of the sensor base or the passage wall, and a flow resistance of the gap being higher than a flow resistance of the first hole.

Another embodiment of the invention defines the flow resistance of the gap between the partition wall integrally formed with the sensor base or the passage wall and its opposite side with respect to the flow resistance of the first hole. Since the sensor base is supported by the film, it suffices that the partition wall have a function of blocking passage of a liquid or bubbles even if the partition wall does not constantly have the support function.

According to the above embodiments of the invention, the casing main body may be part of a container that receives the liquid. Another embodiment of the invention defines a liquid container comprising a casing main body of a liquid detection device as a casing main body of the liquid container.

Since vibrations of the sensor base are absorbed to the liquid container when the casing main body of the liquid detection device is integrated with the liquid container, applying the invention has significant effects. Moreover, it is unnecessary to seal the liquid detection device and the liquid container. Therefore, the number of parts is reduced by eliminating a sealing rubber and a spring. Moreover, assembly properties are improved. The liquid detection device according to the invention is not limited to a device in which the casing main body forms part of the liquid container. Since vibrations are absorbed to a large extent when the volume of the casing main body of the liquid detection device is large. Therefore, the invention has significance effects from the viewpoint that increasing an amplitude detected by the piezoelectric element.

According to another embodiment of the invention, there is provided a method of producing a liquid detection device comprising:

disposing a sensor base provided with a sensor chip that includes a piezoelectric element to face the passage in an opening formed in a casing main body provided with a passage; and welding a film around the opening to support the sensor base provided with the sensor chip by the casing main body through the film and seal the opening, the disposing step including supporting the sensor base by a partition wall that partitions the passage into an upstream side and a downstream side in the casing main body; and the disposing step and the welding step causing the sensor cavity that is formed in the sensor chip and receives a liquid that is a detection target to communicate with the upstream side of the passage through a first hole formed in the sensor base and communicate with the downstream side of the passage through a second hole formed in the sensor base to form a liquid detection path.

In the method according to the invention, the partition wall functions as a support member for the sensor base in the first step, and the partition wall functions to partition the upstream side and the downstream side in the second step.

In the method of producing a liquid detection device according to this embodiment, the sensor base may be supported by the partition wall and an auxiliary support section in the disposing step; and the auxiliary support section may be apart from the sensor base in the welding step.

According to another embodiment of the invention, there is provided a liquid detection device secured to a liquid container that includes a liquid supply port that supplies a liquid contained in the liquid container to the outside, the liquid detection device comprising:

a sensor chip; and a sensor base provided with the sensor chip, the sensor chip having a cavity that receives a liquid that is a detection target through an opening;

the sensor base including a supply path that supplies the liquid to the opening side of the cavity, and a discharge path that discharges the liquid from the opening side of the cavity;

the sensor chip including a diaphragm formed to be able to vibrate and face the cavity, the piezoelectric element being stacked on the diaphragm;

the liquid container including a passage forming section that communicates with the supply path and the discharge path of the liquid detection device; and the liquid detection device being supported on the liquid container by a partition wall and secured to the liquid container by a film, the partition wall dividing the passage forming section into a supply passage that supplies the liquid to the supply path and an introduction passage that introduces the liquid from the discharge path.

This liquid detection device is supported by the partition wall of the liquid container and the film and directly disposed in the liquid container.

Preferred embodiments of the invention are described in detail below. Note that the embodiments described below do not in any way limit the scope of the invention defined by the claims laid out herein. Note that all elements of the embodiments described below should not necessarily be taken as essential requirements for the invention.

Outline of Ink Cartridge

An ink cartridge (liquid container) with a liquid detection device according to one embodiment of the invention is described below with reference to the drawings.

FIG. 1 shows a schematic configuration of an inkjet recording device (liquid consumption device) for which an ink cartridge according to this embodiment is used. A carriage 1 reciprocates in the axial direction of a platen 5 while being guided by a guide member 4 through a timing belt 3 driven by a carriage motor 2.

An inkjet recording head 12 is secured to the carriage 1 on a side opposite to recording paper 6. An ink cartridge 100 that supplies ink to the recording head 12 is removably attached to a holder (not shown) provided on the carriage 1.

A cap member 13 is disposed at a home position (right in FIG. 1) which is a non-print area of the recording device. The cap member 13 is pressed against a nozzle forming surface of the recording head 12 when the recording head 12 secured to the carriage 1 has moved to the home position to form a closed space between the cap member 13 and the nozzle forming surface. A pump unit 10 is disposed under the cap member 13. The pump unit 10 implements cleaning or the like by applying a negative pressure to the closed space formed by the cap member 13.

A wiping means 11 having an elastic plate made of rubber or the like is disposed near the cap member 13 on the print area side so that the wiping means 11 can move forward and backward in the horizontal direction with respect to the moving path of the recording head 12, for example. The wiping means 11 optionally wipes off the nozzle forming surface of the recording head 12 when the carriage 1 reciprocates over the cap member 13.

Figure 2:
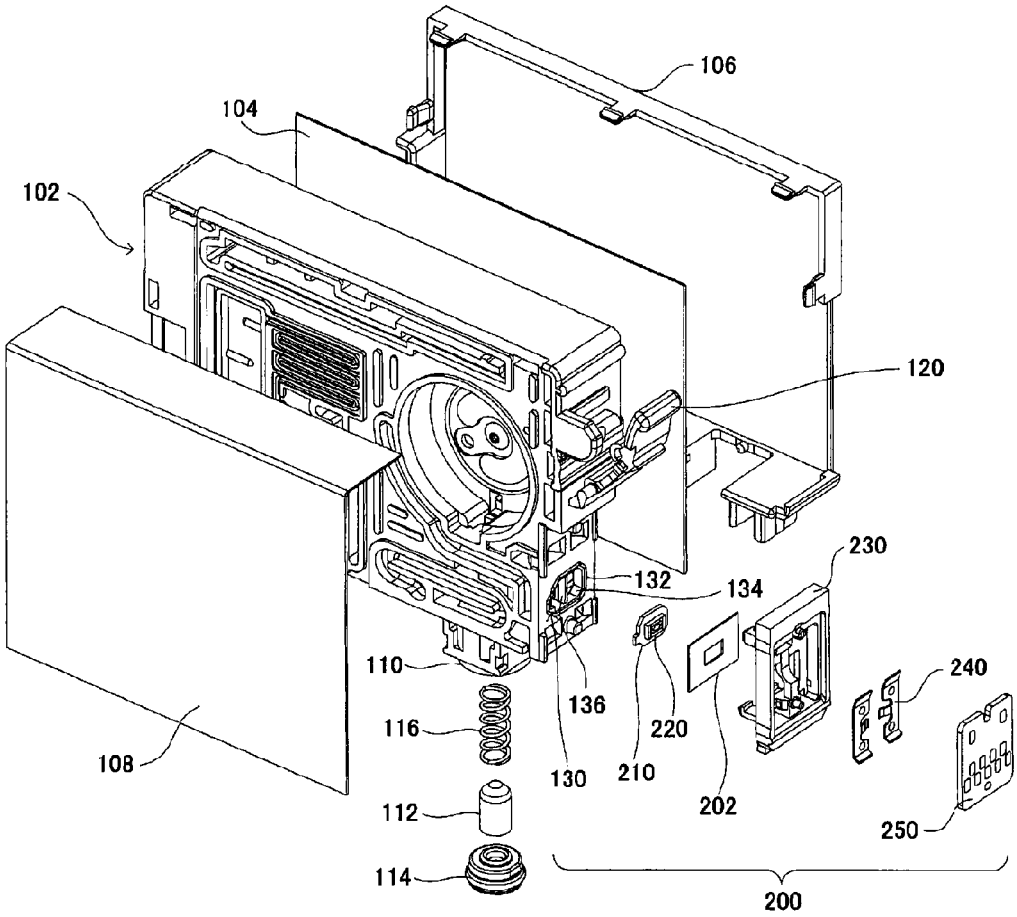
FIG. 2 is an exploded oblique view showing an ink cartridge removably secured to a carriage of a printer.

FIG. 2 is an exploded oblique view showing a schematic configuration of the ink cartridge 100. In FIG. 1, the vertical direction coincides with the vertical direction of the ink cartridge 100 which is secured to the carriage 1. The term "vertical direction" used hereinafter refers to the vertical direction when the ink cartridge 100 is secured to the carriage 1.

The ink cartridge 100 includes a film 104 which covers the back surface of a casing main body 102, a lid 106 which covers the film 104 and the bottom surface of the casing main body 102, and a film 108 which covers the front surface and the upper surface of the casing main body 102.

The casing main body 102 is intricately partitioned using ribs and walls. The casing main body 102 includes an ink passage section which includes an ink receiving area and an ink supply passage, an ink side passage through which the ink receiving area communicates with the air, and an air communication section which includes an air valve chamber and an air side passage. The details thereof are omitted (see JP-A-2007-15408, for example).

The ink supply passage of the ink passage section communicates with an ink supply section 110. Ink contained in the ink cartridge 100 is sucked up by a negative pressure through the ink supply section 110 and is supplied from the ink supply section 110.

An ink supply needle (not shown) of the holder secured to the carriage 1 is fitted to the ink supply section 110. The ink supply section 110 is provided with a supply valve 112 which slides and opens when pressed by the ink supply needle, a seal member 114 which is formed of an elastic material such as an elastomer and into which the ink supply needle fits, and a biasing member 116 which is formed of a coil spring and biases the supply valve 112 toward the seal member 114. These members are assembled by positioning the biasing member 116, fitting the seal member 114 into the ink supply section 110, and pushing the supply valve 112.

A lever 120 which engages with the holder secured to the carriage 1 is provided on one side surface of the casing main body 102. An opening 130 which is provided on the upstream side of the ink supply section 110 and into which an end position of the ink supply passage opens is formed in one side surface of the casing main body 102 at a position lower than the lever 120, for example. A welding rib 132 is formed on the periphery of the opening 130. A partition rib 136 is formed which partitions an ink supply passage 134 which communicates with the opening 130 into an upstream buffer chamber 134*a* and a downstream buffer chamber 134*b* (the symbols are omitted in FIG. 2; see FIGS. 6 and 7).

Ink Detection Device

Figure 3:
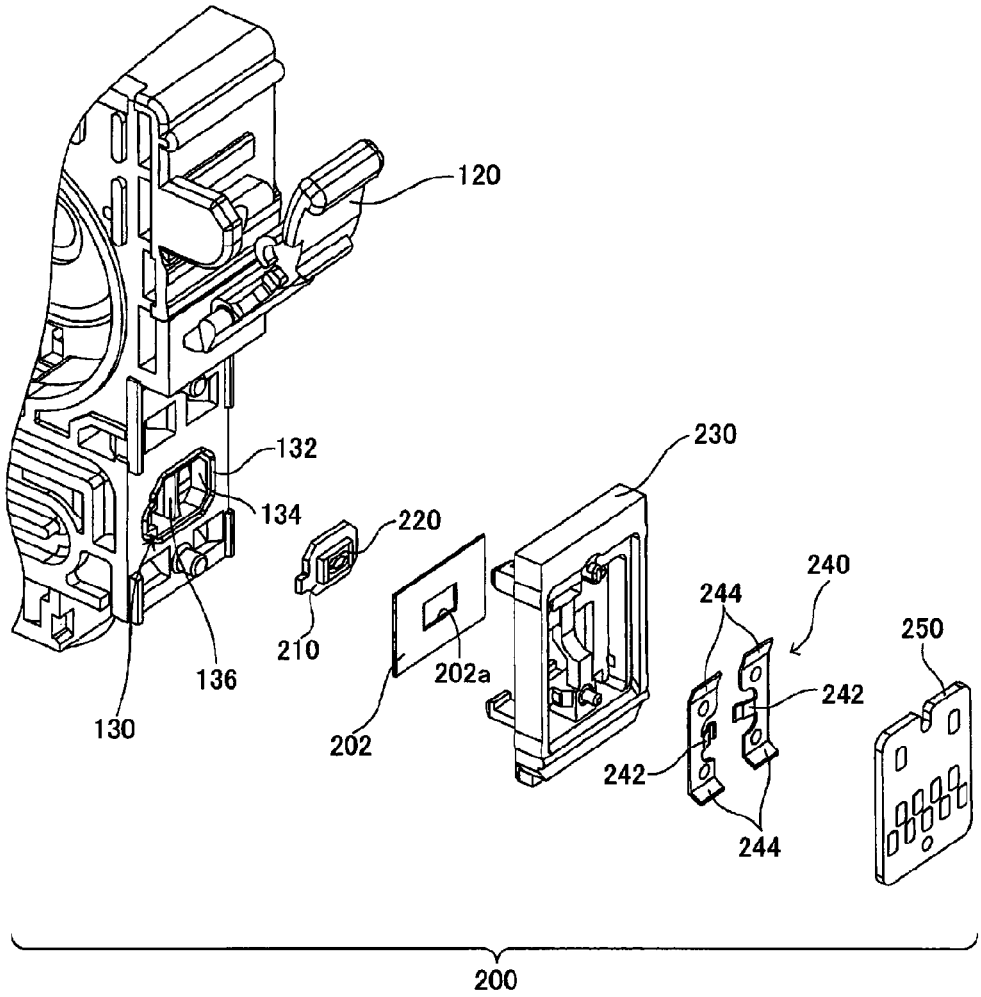
FIG. 3 is a partially enlarged exploded oblique view showing an ink detection device.

An outline of an ink detection device 200 according to a liquid detection device according to the invention which is formed using the casing main body 102, the ink supply passage 134, and the partition rib 136 is described below with reference to FIGS. 2 and 3. FIG. 3 is an enlarged view showing the ink detection device 200 included in the ink cartridge 100 shown in FIG. 2.

As shown in FIGS. 2 and 3, the ink detection device 200 includes the casing main body 102 which is formed of a resin and in which the ink supply passage 134 is formed, a metal sensor base 210 disposed to face the ink supply passage 134 through the opening 130 formed in the casing main body 102, a sensor chip 220 provided on the side of the sensor base 210 opposite to the side which faces the ink supply passage 134, a film 202 which holds the sensor base 210 in the opening 130 and seals the opening 130, and the partition wall (rib) 136 which partitions the ink supply passage 134 into an upstream side and a downstream side inside the casing main body 102. The film 202 is bonded to the upper surface of the sensor base 210, and is welded to the welding rib 132 provided around the opening 130.

As shown in FIGS. 2 and 3, the ink detection device 200 further includes a cover 230 disposed over the sensor base 210, the sensor chip 220, and the film 202, a relay terminal 240 which is accommodated in the cover 230 and includes terminals 242 which electrically contact the sensor chip 220 through a hole 202*a* formed in the film 202, and a circuit board 250 which is accommodated in the cover 230 and is electrically connected to terminals 244 of the relay terminal 240. Note that the cover 230, the relay terminal 240, and the circuit board 250 are not elements indispensable for the liquid detection device 200 according to the present invention.

Figure 4:
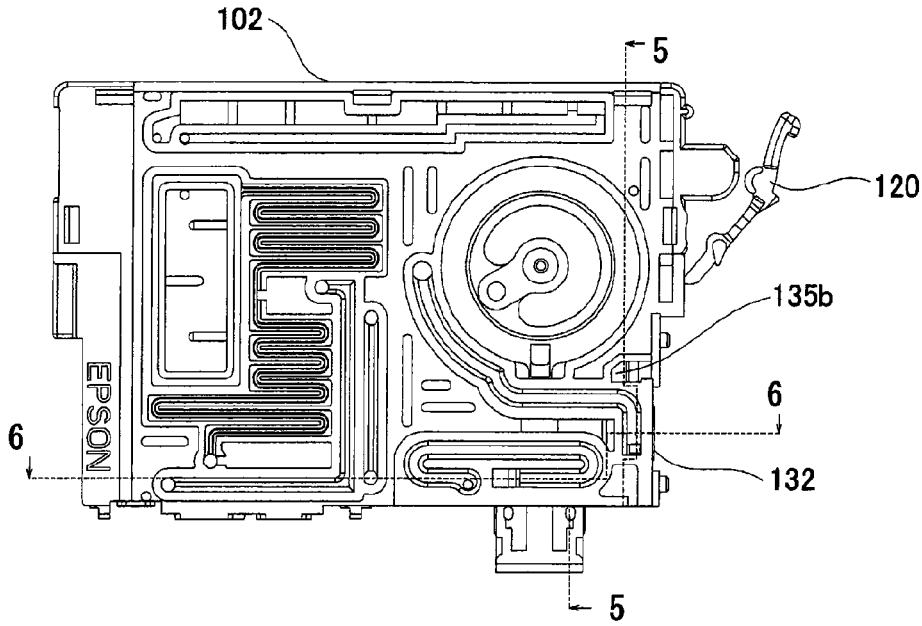
FIG. 4 is a front view showing an ink cartridge.
Figure 5:
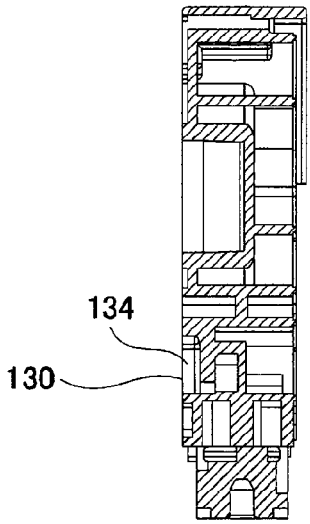
FIG. 5 is a cross-sectional view along a line 5-5 in FIG. 4.

The details of the ink detection device 200 are described below with reference to FIGS. 4 to 11. FIG. 4 is a front view showing the casing main body 102. As shown in FIG. 5 (cross-sectional view along the line 5-5 in FIG. 4), the ink supply passage 134 passes through (exposes) the opening 130 at an end position before reaching the ink supply section 110 shown in FIG. 1.

Figure 6:
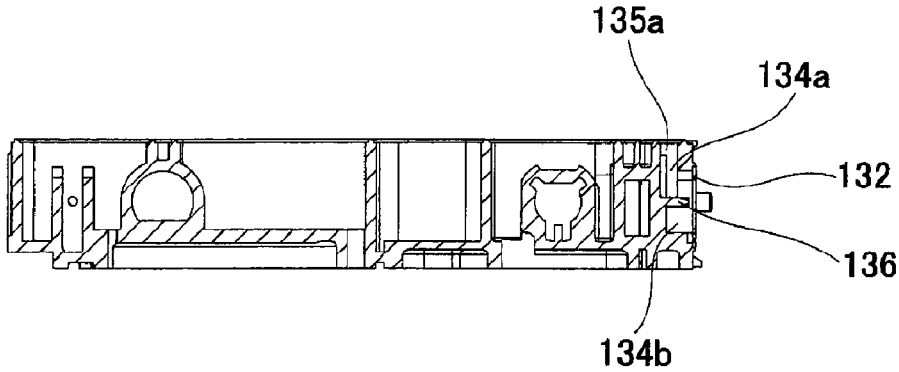
FIG. 6 is a cross-sectional view along a line 6-6 in FIG. 4.
Figure 7:
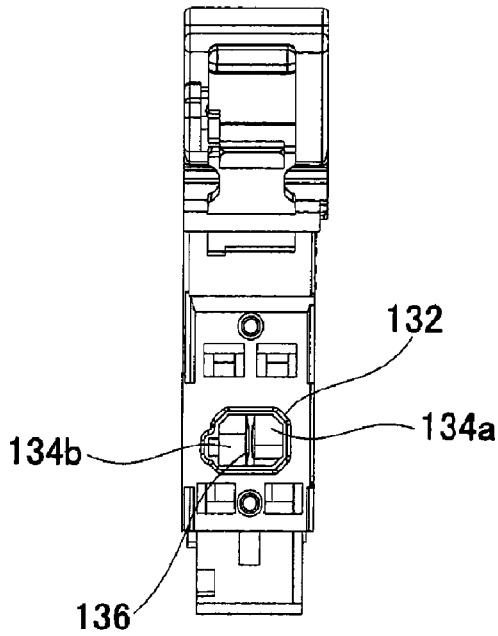
FIG. 7 is a right side view showing an ink cartridge.

As shown in FIG. 6 (cross-sectional view along the line 6-6 in FIG. 4) and FIG. 7 (right side view of the ink cartridge 100), the ink supply passage 134 positioned inside the opening 130 is partitioned into the upstream buffer chamber 134*a* and the downstream buffer chamber 134*b* by the partition wall 136. As shown in FIG. 6, a supply port 135*a* is disposed to face the upstream buffer chamber 134*a*. As shown in FIG. 4, a discharge port 135*b* is disposed to face the downstream buffer chamber 134*b*.

Figure 8:
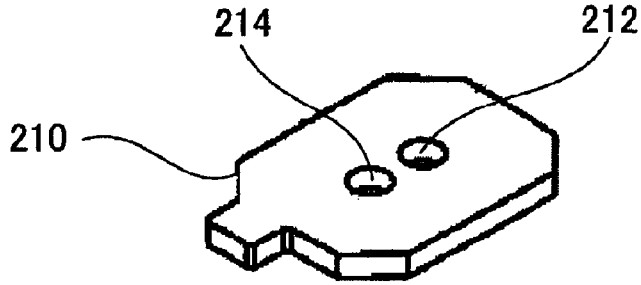
FIG. 8 is an oblique view showing a sensor base from the back surface.
Figure 9:
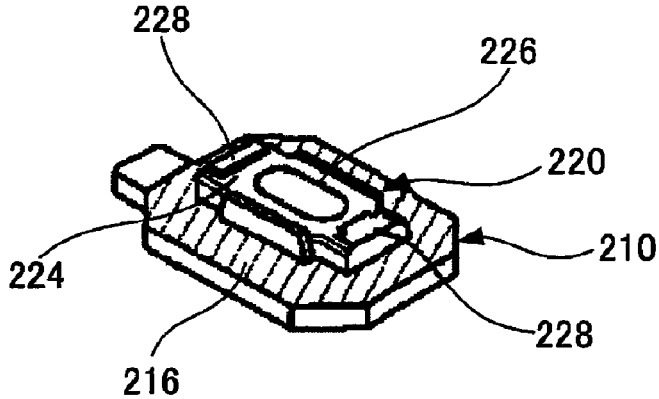
FIG. 9 is an oblique view showing a sensor base provided with a sensor chip from the front surface.

FIG. 8 is an oblique view showing the sensor base 210 from the lower side. As shown in FIG. 9, a first hole (supply passage) 212 and a second hole (discharge passage) 214 are formed through the sensor base 210 in the thickness direction.

Figure 10:
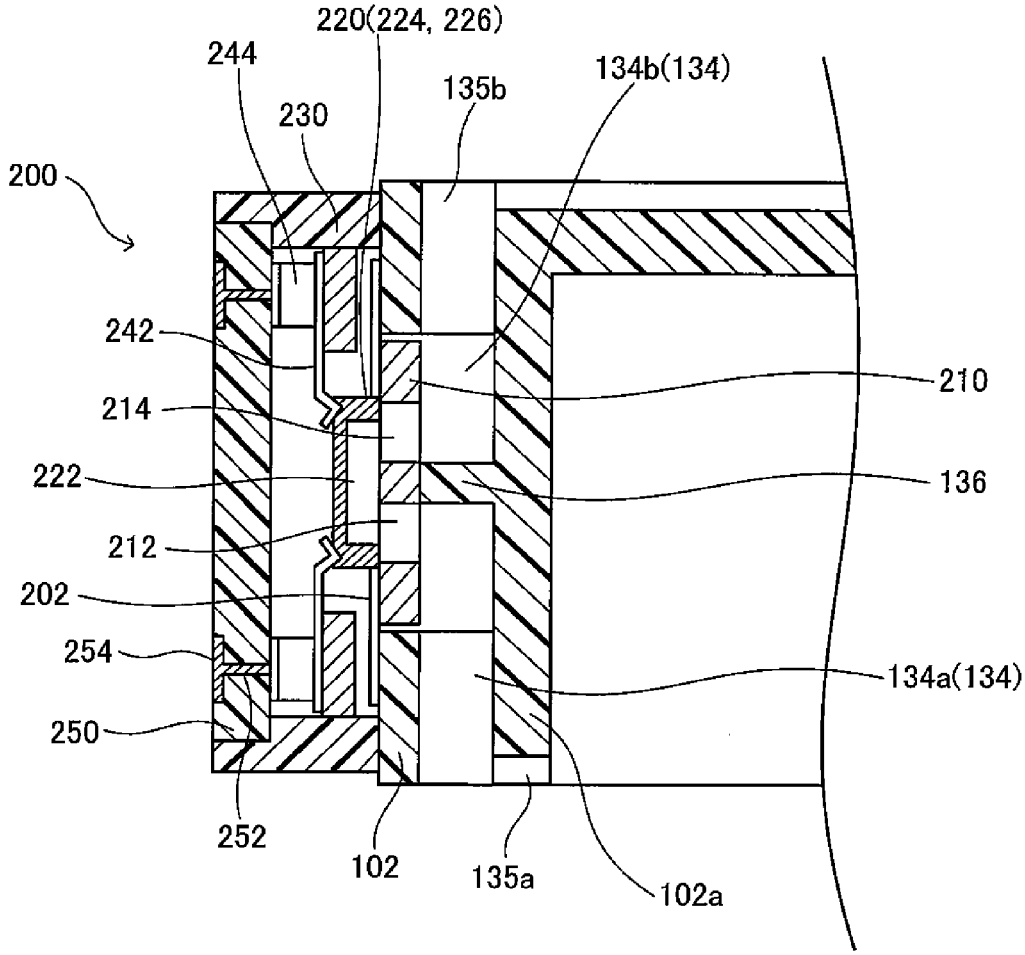
FIG. 10 is a cross-sectional view showing an ink detection device after assembly.
Figure 15:
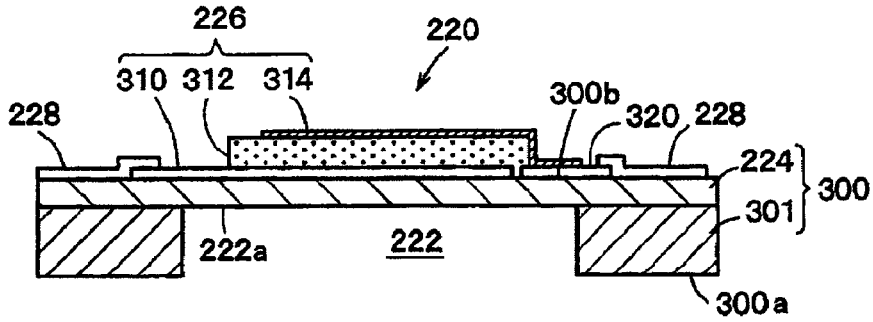
FIG. 15 is a cross-sectional view showing a sensor chip.

FIG. 9 is an oblique view showing the sensor base 210 provided with the sensor chip 220 from the upper side. FIG. 10 is a cross-sectional view schematically showing a state in which the ink detection device 200 shown in FIGS. 2 and 3 is assembled. FIG. 15 is a cross-sectional view showing the sensor chip.

As shown in FIGS. 10 and 15, the sensor chip 220 has a sensor cavity 222 which receives a detection target ink (liquid). The bottom surface of the sensor cavity 222 is open so that the ink can enter the sensor cavity 222. As shown in FIGS. 9 and 15, the upper side of the sensor cavity 222 is covered with a diaphragm 224. A piezoelectric element 226 is disposed on the upper surface of the diaphragm 224.

As shown in FIG. 15, the sensor chip 220 includes a vibration cavity forming base 300 which is formed by stacking a cavity plate 300 and the diaphragm 224 and has a first surface 300*a* and a second surface 300*b* opposite to the first surface 300*a*. The sensor chip 220 further includes the piezoelectric element 226 stacked on the second surface 300*b* of the cavity forming base 300.

The cavity 222 which has a cylindrical shape that receives a detection target medium (ink) is formed in the vibration cavity forming base 300 so that the cavity 222 opens on the side of the first surface 300*a*. A bottom portion 222*a* of the cavity 222 can vibrate due to the diaphragm 224. In other words, a portion of the diaphragm 224 which actually vibrates is specified by the cavity 222. Electrode terminals 228 are formed on the ends of the second surface 300*b* of the vibration cavity forming base 300.

A lower electrode 310 is formed on the second surface 300*b* of the vibration cavity forming base 300. The lower electrode 310 is connected to one of the electrode terminals 228.

A piezoelectric layer 312 is stacked on the lower electrode 310. An upper electrode 314 is stacked on the piezoelectric layer 312. The upper electrode 314 is connected to an auxiliary electrode 320 from the lower electrode 310. The other electrode terminal 228 is connected to the auxiliary electrode 320.

The piezoelectric element 226 functions to determine an ink end (run out) state based on the difference in electrical characteristics (e.g., frequency) due to the presence or absence of ink in the sensor cavity 222, for example. As the material for the piezoelectric layer, lead zirconate titanate (PZT), lead lanthanum zirconate titanate (PLZT), a leadless piezoelectric film, or the like may be used.

The sensor chip 220 is integrally secured to the sensor base 210 through an adhesive layer 216 by placing the bottom surface of the chip main body at the center of the upper surface of the sensor base 210. The space between the sensor base 210 and the sensor chip 220 is sealed with the adhesive layer 216.

Detection of Ink Level (Amount of Remaining Ink)

As shown in FIG. 10, ink introduced into the ink supply passage 134 through the supply port 135*a* remains in an upstream buffer chamber 134*a* which is one of the chambers partitioned by the partition wall 136.

The upstream buffer chamber 134*a* communicates with the sensor cavity 222 formed in the sensor base 210 through the first hole 212 formed in the sensor chip 220. Therefore, the ink in the upstream buffer chamber 134*a* is introduced into the sensor cavity 222 through the first hole 212 when the ink is discharged. Vibrations from the diaphragm 224 which vibrates due to the piezoelectric element 226 are transmitted to the ink, and the presence or absence of the ink is detected depending on the frequency of the residual vibration waveform. At an end point at which air is mixed into the sensor cavity 222 in addition to the ink, since the residual vibration waveform is attenuated to a large extent, the frequency increases as compared with the case where the sensor cavity 222 is filled with the ink. An ink end state can be detected by detecting such an increase in frequency.

Specifically, when a voltage is applied to the piezoelectric element 226, the diaphragm 224 is deformed due to deformation of the piezoelectric element 226. When application of a voltage is stopped after causing the piezoelectric element 226 to be deformed, flexural vibrations remain in the diaphragm 224 for a period of time. The residual vibrations occur due to free vibrations of the diaphragm 224 and the medium in the sensor cavity 222. Therefore, a resonance state of the diaphragm 224 and the medium after applying a voltage can be easily obtained by applying a voltage with a pulse waveform or a rectangular waveform to the piezoelectric element 226.

Since the residual vibrations occur due to vibrations of the diaphragm 224, the piezoelectric element 226 is inevitably deformed. Therefore, the piezoelectric element 226 produces a counter electromotive force due to the residual vibrations.

As shown in FIG. 10, the circuit board 250 includes an electrode 254 connected to a through-hole 252 formed through the circuit board 250. A signal from the relay terminal 240 which contacts the sensor chip 220 is transmitted to an analysis circuit (not shown) provided in a printer through the through-hole 252 and the electrode 254 and processed by the analysis circuit. The analysis result is transmitted to a semiconductor memory device (not shown) mounted on the circuit board 250. Specifically, the counter electromotive force produced by the piezoelectric element 226 is transmitted to the analysis circuit through the relay terminal 240, and the analysis results is stored in the semiconductor memory device.

Since the resonance frequency can be specified based on the detected counter electromotive force, the presence or absence of the ink in the ink cartridge 100 can be detected based on the resonance frequency. Note that the semiconductor memory device stores identification data (e.g., type) relating to the ink cartridge 100, information relating to the color of the ink contained in the ink cartridge 100, and information such as the ink level.

The ink which remains in the sensor cavity 222 is introduced into the downstream buffer chamber 134*b* through a second hole 214 formed in the sensor base 210 when the ink is further supplied. The ink flows through the ink supply passage 134 via the ink discharge port 135*b*, and is discharged from the ink cartridge 100 through the ink supply section 110 (see FIG. 2).

Sensor Base Support Method and Support Structure

The following two steps are necessary when installing the sensor base 210, the sensor chip 220, and the film 202 in the opening 130. Specifically, it is necessary to perform a first step of disposing the metal sensor base 210 provided with the sensor chip 220 in the opening 130 formed in the casing main body 102 in which the passage 134 is formed so that the metal sensor base 210 faces the passage 134, and a second step of welding the film 202 to the rib 132 formed around the opening 130 so that the sensor base 210 is supported by the casing main body 102 through the film 202. Note that the first step and the second step allow the sensor cavity 222 formed in the sensor chip 220 to communicate with the upstream buffer chamber 134*a* through the first hole 212 formed in the sensor base 210 and communicate with the downstream buffer chamber 134*b* through the second hole 214 formed in the sensor base 210 to form a liquid detection path, as described above.

In this embodiment, the sensor base 210 is supported only by the partition wall 136 (support function of the partition wall) in the first step before welding the film 202. Specifically, the sensor base 210 must be temporarily positioned at a specific position of the opening 130 before the film 202 is welded to the welding rib 132 around the opening 130. After the sensor base 210 has been supported by the film 202 as a result of the second step, the sensor base 210 can contact only the partition wall 136 in the depth direction of the opening 130 (upstream/downstream partition function of the partition wall). Since the sensor base 210 is supported by the film 202, the sensor base 210 need not be always in contact with the partition wall 136. On the other hand, the partition wall 136 must constantly achieve the upstream/downstream partition function.

In this embodiment, as shown in FIG. 10, a passage wall 102*a* disposed opposite to the sensor base 210 is provided in order to divide (partition) the ink supply passage 134. The partition wall 136 is integrally formed with the passage wall 102*a*. The partition wall 136 is an indispensable structure in order to divide the ink supply passage 134 into the upstream buffer chamber 134*a* and the downstream buffer chamber 134*b*. If the partition wall 136 does not exist, the ink or bubbles as the medium in the ink supply passage 134 do not necessarily pass through the sensor cavity 222. If the ink or bubbles in the ink supply passage 134 do not pass through the sensor cavity 222, the sensor chip 220 erroneously detects an ink end state.

In order to divide the ink supply passage 134 into the upstream buffer chamber 134*a* and the downstream buffer chamber 134*b*, it is necessary for the partition wall 136 to contact the sensor base 210 or be closely positioned with respect to the sensor base 210 so that at least bubbles do not pass through the space between the sensor base 210 and the partition wall 136. Specifically, the flow resistance must be larger than the flow resistance of the first hole 212 so that at least bubbles do not pass through. This is the original function of the partition wall 136.

On the other hand, since the partition wall 136 is supported in contact with the sensor base 210 when installing the sensor base 210 (first step), a situation in which the sensor base 210 deeply penetrates the opening 130 can be prevented. Specifically, the partition wall 136 has a function of temporarily supporting the sensor base 210 in the first step.

After the film 202 has been welded to the welding rib 132 around the opening 130 so that the sensor base 210 and the sensor chip 220 have been installed in the opening 130, the sensor base 210 only contacts the partition wall 136 except for the sensor chip 220 and the film 202. Specifically, the sensor base 210 can come into contact with only the partition wall 136 in the depth direction of the opening 130.

This makes it possible to detection the residual vibration waveform due to the piezoelectric element 226. In this embodiment, the casing main body 102 of the ink detection device 200 is part of the casing main body of the ink cartridge 100, and has a large volume. The casing main body 102 is generally formed of a flexible material such as a resin (e.g., polypropylene). When the volume of the casing main body 102 is large, absorption of vibrations increases.

When the piezoelectric element 226 vibrates, the diaphragm 224 and the sensor base 210 provided with the sensor chip 220 also vibrate. When the contact area between the sensor base 210 and the casing main body 102 is large, vibrations of the sensor base 210 are absorbed by the casing main body 102. In this case, the residual vibration waveform does not have an amplitude sufficient for detection by the piezoelectric element 226.

In this embodiment, since the sensor base 210 is supported only by the film 202 and the partition wall 136, vibration waves are absorbed by the main body 102 to a minimum extent. Therefore, a sufficient amplitude which can be detected by the piezoelectric element 226 is achieved.

Figure 11:
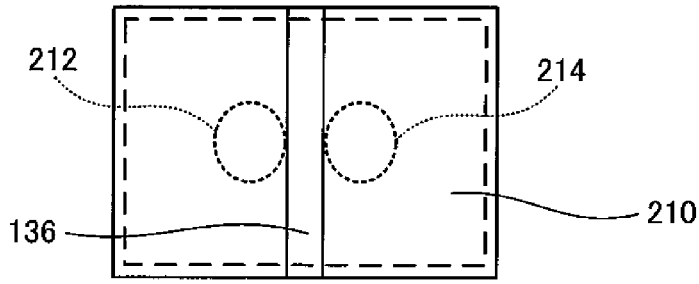
FIG. 11 is a schematic explanatory diagram showing the positional relationship between first and second holes of a sensor base and a partition wall.

FIG. 11 is a bottom view across the partition wall 136. The partition wall 136 is positioned between the first and second holes 212 and 214 formed in the sensor base 210. The end of the partition wall 136 has the maximum thickness when the partition wall 136 contacts the first and second holes 212 and 214. The partition wall 136 must not cover the first and second holes 212 and 214. If the first and second holes 212 and 214 are covered with the partition wall 136, the flow resistances of the first and second hole which are designed in advance increase.

Modification

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention. Any term cited with a different term having a broader meaning or the same meaning at least once in the specification and the drawings can be replaced by the different term in any place in the specification and the drawings.

Figure 12A:
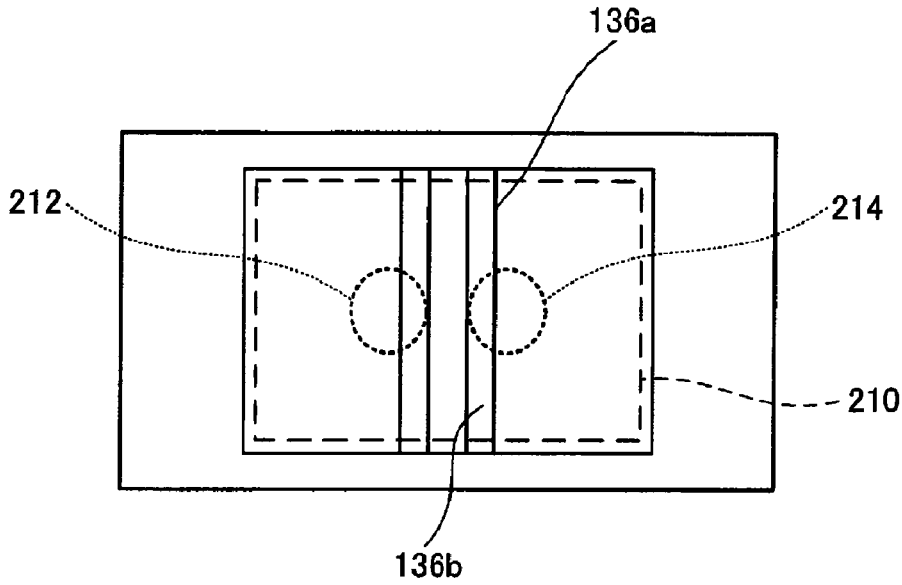
FIGS. 12A and 12B are views showing a modification of a partition wall.
Figure 12B:
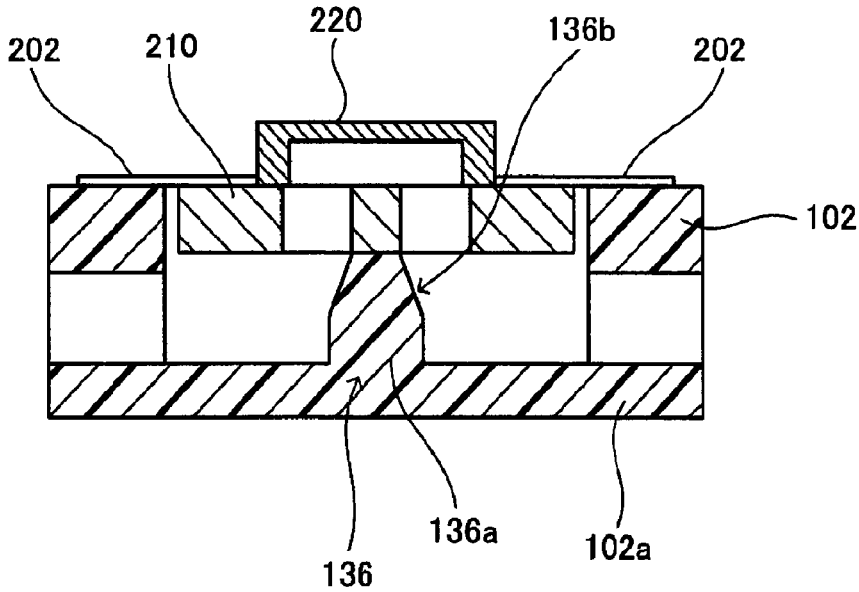

As shown in FIGS. 12A and 12B, the partition wall 136 may have a tapered shape in which the thickness of a free end 136*b* is smaller than the thickness of a base end 136*a* secured to the passage wall 102*a*. Specifically, even if the base end 136*a* is wider than the distance between the first and second holes 212 and 214, it suffices that the thickness of the free end 136*b* be equal to or less than the distance between the first and second holes 212 and 214 in the same manner as in FIG. 10. This does not cause an increase in flow resistance of the first and second holes 212 and 214. Injection moldability can be improved by increasing the thickness of the base end 136*a*. As the method of reducing the thickness of the free end 136*b*, the free end may be curved instead of forming a tapered surface (see FIG. 12B).

Figure 13A:
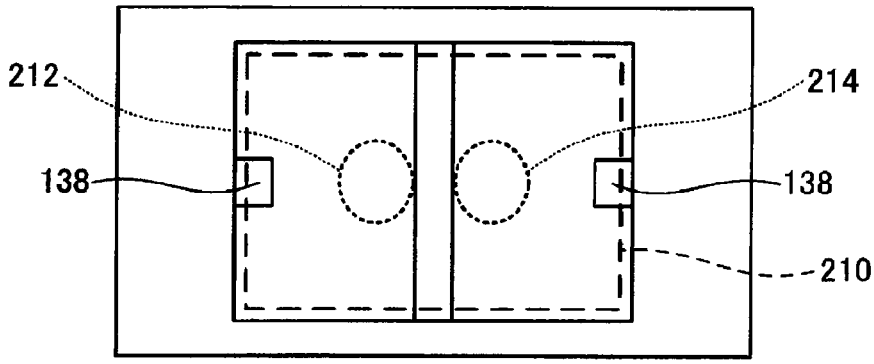
FIGS. 13A and 13B are views showing a modification in which an auxiliary support section is provided.
Figure 13B:
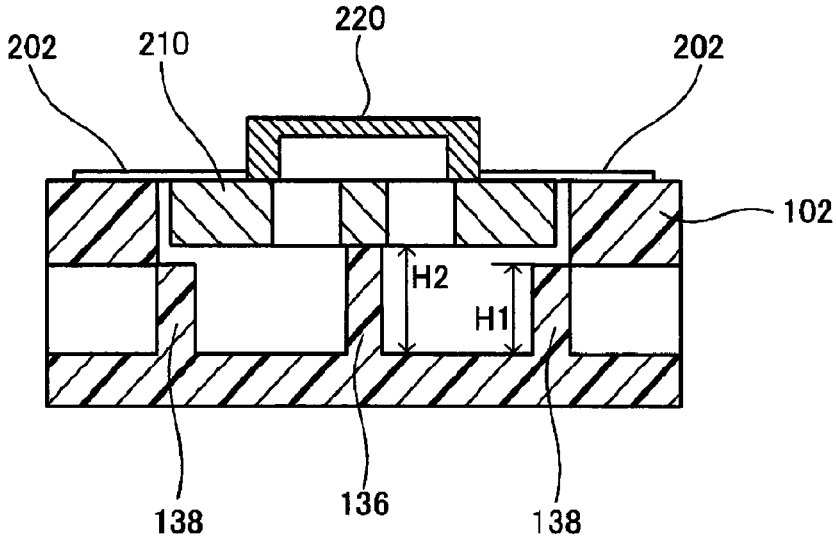

A configuration shown in FIGS. 13A and 13B may be employed in order to improve the installation stability of the sensor base 210. Specifically, an auxiliary support rib 138 other than the partition wall 136 may be provided. In FIGS. 13A and 13B, two auxiliary support ribs 138 are disposed which can come into contact with the sensor base 210 on either end in the longitudinal direction. Note that a height H1 from the passage wall 102*a* to the end of the auxiliary support ribs 138 is smaller than a height H2 from the passage wall 102*a* to the end of the partition wall 136.

In the embodiment shown in FIG. 10, since the sensor base 210 is supported by only the partition wall 136 during installation, the sensor base 210 is supported at the center in the same manner as a seesaw (i.e., unstable). In the embodiment shown in FIGS. 13A and 13B, even if the sensor base 210 inclines, the end of the sensor base 210 contacts the auxiliary support rib 138. Therefore, the sensor base 210 is supported by two points (i.e., supported by the partition wall 136 and the auxiliary support rib 138).

Since the sensor base 210 is disposed almost in parallel with the passage wall 102*a* after assembly, as shown in FIG. 13B, the sensor base 210 does not contact the auxiliary support rib 138. Therefore, a large amplitude of the residual vibration waveform can be ensured in the same manner as in the embodiment shown in FIG. 10.

The auxiliary support rib 138 can prevent the sensor base 210 from inclining to a large extent even if an abnormality such as drop impact force occurs after the sensor base 210 has been assembled. Therefore, a situation can be prevented in which the sensor base 210 supported by the film 202 inclines to a large extent to break the film 202.

Figure 14:
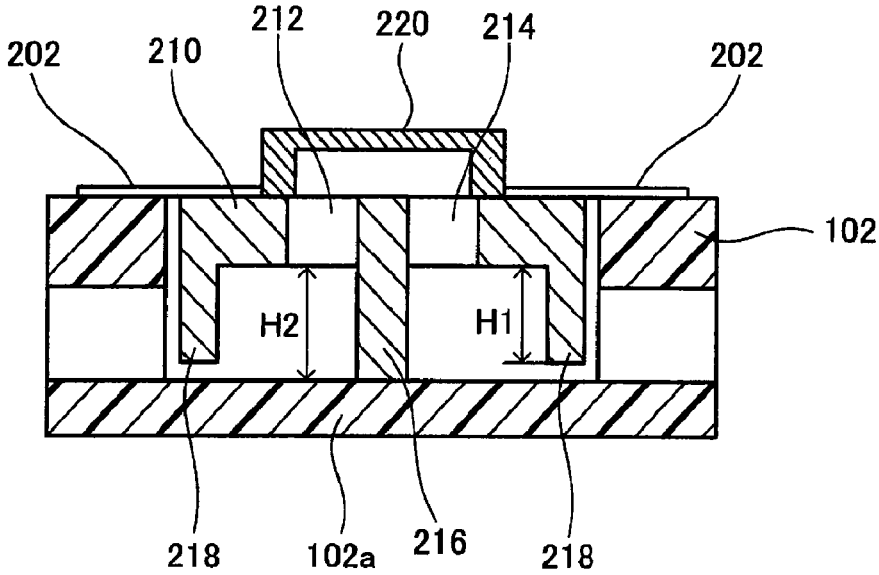
FIG. 14 is a view showing a modification in which a sensor base is provided with a partition wall and an auxiliary support section.

The partition wall 136 may not be provided on the passage wall 102*a*. As shown in FIG. 14, a partition wall 216 may be provided which is suspended from the sensor base 210 between the first and second holes 212 and 214, for example. The partition wall 216 contacts the passage wall 102*a*, or is opposite to the passage wall 102*a* through a small space with a flow resistance larger than that of the first hole 212. In FIG. 14, an auxiliary support rib 218 is provided which is suspended from the sensor base 210 on each end in the longitudinal direction, for example. A height H1 from the bottom surface of the sensor base 210 to the end of the auxiliary support ribs 218 is smaller than a height H2 from the bottom surface of the sensor base 210 to the end of the partition wall 216. This also achieves the same effect as that of the embodiment shown in FIGS. 13A and 13B. A partition wall may be provided to one of the passage wall 102*a* and the sensor base 210, and an auxiliary support rib may be provided to the other. When providing the partition wall 216 and the auxiliary support rib 218 to the sensor base 210, the sensor base 210 is formed by cutting work, for example.

A structure which prevents erroneous detection due to bubbles is described below with reference to FIGS. 16 to 21.

Figure 16:
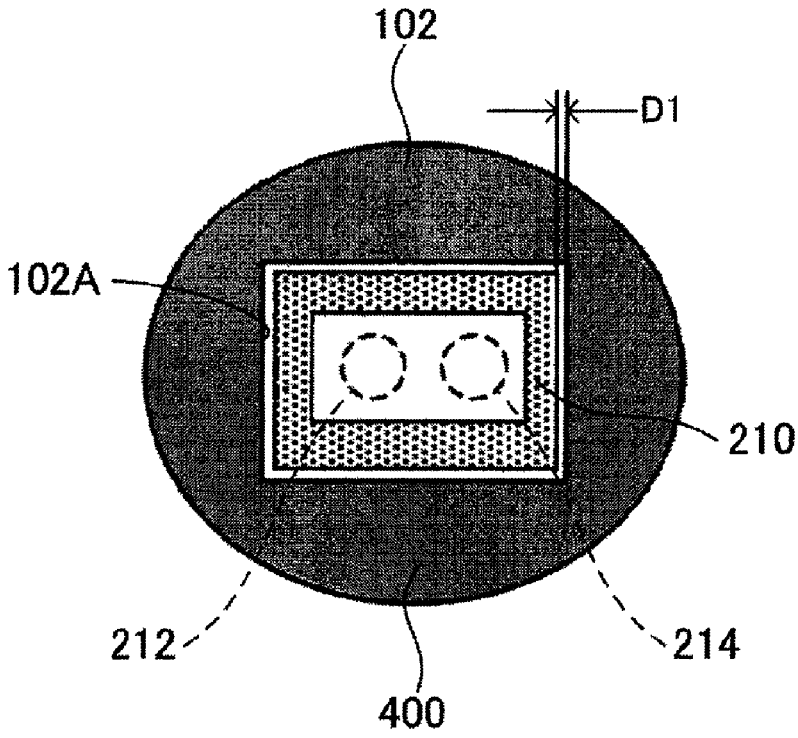
FIG. 16 is a plan view schematically showing an installation structure of a sensor base 210 shown in FIG. 12B, 13B, or 14.

FIG. 16 is a plan view schematically showing the installation structure of the sensor base 210 shown in FIG. 12B, 13B, or 14. In FIG. 16, the film 202 is omitted. As shown in FIG. 16, an opening 102A is formed in the casing main body 102. The sensor base 210 is supported by the film 202 in a state in which the sensor base 210 is disposed in the opening 102A. Note that the film 202 is not shown In FIG. 16.

A small gap D1 is formed between the inner wall of the opening 102A and all sides of the rectangular sensor base 210. The sensor base 210 is positioned in the opening 102A by setting the design tolerance in order to reduce the gap D1.

A problem relating to the structure shown in FIG. 16 is as follows. The casing main body 102 is filled with ink in a state in which the inside of the casing main body 102 is approximately under vacuum. A gap 103 communicates with the upstream buffer chamber 134*a* or the downstream buffer chamber 134*b* shown in FIG. 10. Since the opening is too small to allow ink to enter the opening, bubbles remain in the gap D1 when the upstream buffer chamber 134*a* or the downstream buffer chamber 134*b* are filled with ink.

Since the film 202 (e.g., polypropylene (pp)) has gas permeability, bubbles become larger by incorporating gas over a long time. The bubbles exit the gap D1 due to vibrations of the piezoelectric element 226 (see FIG. 1) provided on the sensor base 210, for example, and enter the upstream buffer chamber 134*a* or the downstream buffer chamber 134*b* which communicates with the sensor cavity 222 shown in FIG. 10. When the bubbles reach the sensor cavity 222, an ink end state is erroneously detected even though the ink remains.

Figure 17C:
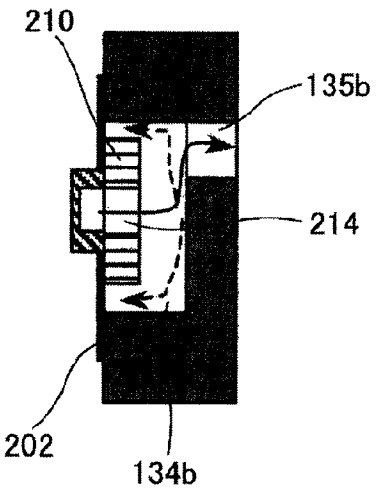
FIG. 17C is a cross-sectional view along a line 17C-17C in FIG. 17A.
Figure 17B:
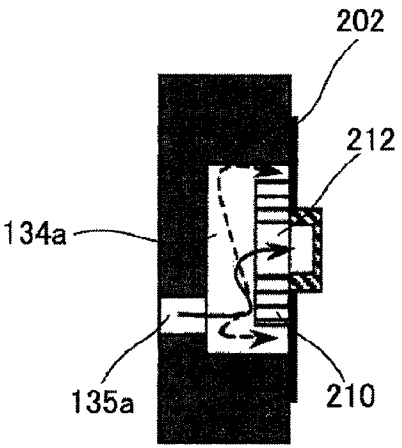
FIG. 17B is a cross-sectional view along a line 17B-17B in FIG. 17A.
Figure 17A:
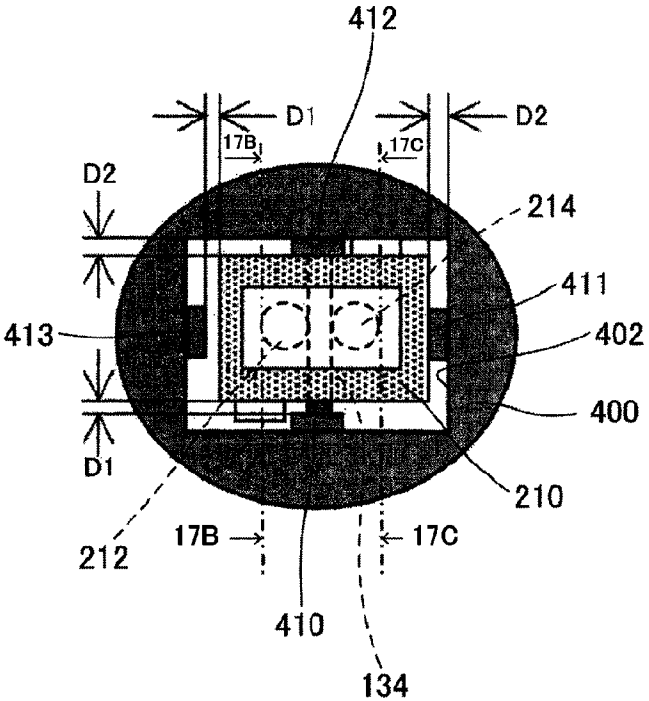
FIG. 17A is a plan view according to this embodiment showing the same state as in FIG. 16.

FIGS. 17A to 17C schematically show a structure which suppresses the above problem. FIG. 17A is a plan view according to this embodiment similar to FIG. 16. FIG. 17B is a cross-sectional view along the line 17B-17B in FIG. 17A, and FIG. 17C is a cross-sectional view along the line 17C-17C in FIG. 17A.

FIG. 17A shows a solution principle. Therefore, the sensor base 210 is schematically illustrated in a rectangular shape. Four positioning sections 410, 411, 412, and 413 which protrude toward the four sides of the sensor base 210 are provided in an opening 402 at positions opposite to the four sides of the sensor base 210.

As shown in FIG. 17A, an gap D1 is formed between the sensor base 210 (in the short side direction) and each of the positioning sections 410 and 412. Likewise, an gap D1 is formed between the sensor base 210 (in the long side direction) and each of the positioning sections 411 and 413. The sensor base 210 can be positioned using the four positioning sections 410 to 413 by specifying the gap D1 within the design dimensional tolerance. Note that the dimension of the gap D1 is the same as that of the gap D1 shown in FIG. 16. The gap D1 is too narrow to allow the ink to enter the gap D1.

An gap D2 sufficiently larger than the gap D1 according to the above design tolerance is formed between the wall of the opening 402 and each side of the sensor base 210 in an area excluding the four positioning sections 410, 411, 412, and 413. The gap D2 forms part of the passage 134 which is formed by the upstream buffer chamber 134*a* or the downstream buffer chamber 134*b* shown in FIG. 17B or 17C partitioned by the partition wall 136 shown in FIG. 17A.

Specifically, when injecting an ink, the ink is introduced into the sensor cavity 222 through the first hole 212 formed in the sensor base 210, as indicated by a solid line in FIG. 17B. On the other hand, the ink introduced through the supply port 135*a* connected to the first buffer chamber 134*a* collides against the wall (sensor base 210) positioned forward in the travel direction and is dispersed, as indicated by a broken line in FIG. 17B. Therefore, the ink enters the gap D2 around the sensor base 210. Alternatively, the ink is guided from the sensor cavity 222 into the discharge port 135*b* through the second hole 214 formed in the sensor base 210, as indicated by a solid line in FIG. 17C. On the other hand, the ink introduced through the second hole 214 collides against the wall (wall of the downstream buffer chamber 134*b*) positioned forward in the travel direction and is dispersed, as indicated by a broken line in FIG. 17C. Therefore, the ink enters the gap D2 around the sensor base 210.

The gap D2 is filled with the ink in this manner so that bubbles do not remain. This prevents erroneous detection of an ink end state.

In order to allow the ink to easily enter the gap D2, it is preferable that the supply port 135*a* of the upstream buffer chamber 134*a* is not opposite to the first hole 214 of the sensor base 210, and that the discharge port 135*b* of the downstream buffer chamber 134*b* is not opposite to the first hole 214 of the sensor base 210. According to this configuration, since the wall exists in front of the introduced or discharged ink in the travel direction, the ink is dispersed and easily enters the gap D2.

The opposite positioning sections 410 and 412 among the four positioning sections are situated on the extension of the partition wall 136 (see FIG. 17A). If the positioning sections 410 and 412 are not formed on the extension of the partition wall 136, a passage which connects one side and the other side of the partition wall 136 is formed by the gap D, whereby an ink passage which does not pass through the sensor cavity 222 is formed.

Figure 18:
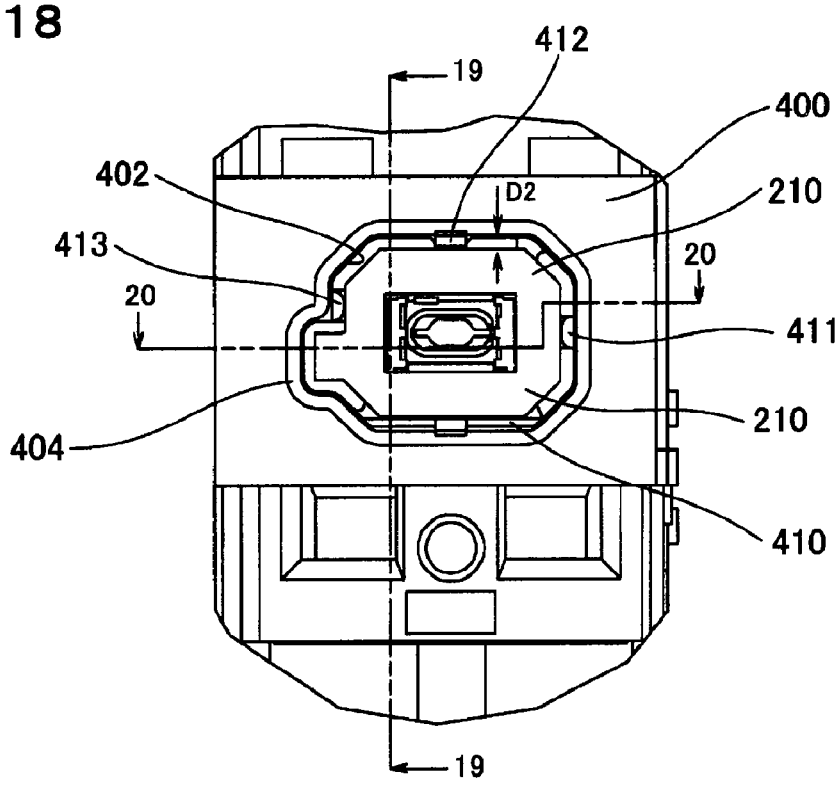
FIG. 18 is a plan view showing a specific embodiment of FIG. 17.
Figure 19:
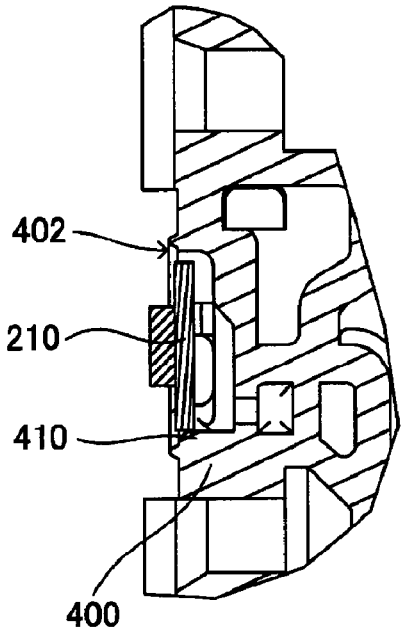
FIG. 19 is a cross-sectional view along a line 19-19 in FIG. 18.
Figure 20:
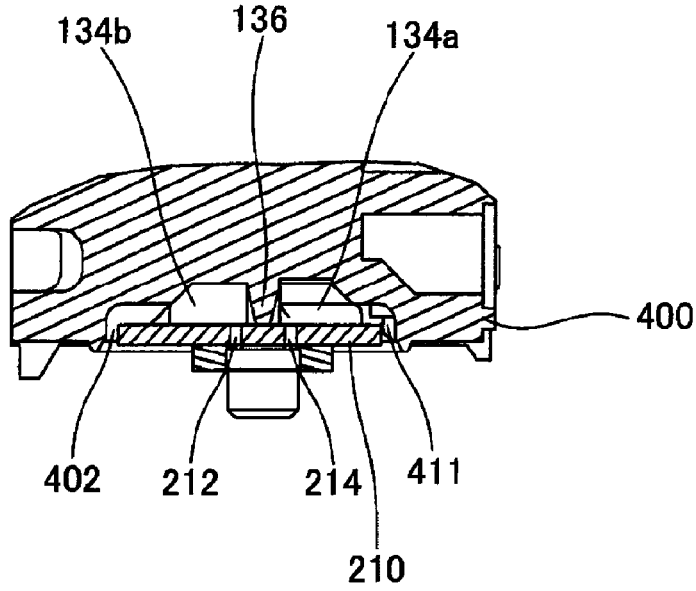
FIG. 20 is a cross-sectional view along a line 20-20 in FIG. 18.
Figure 21:
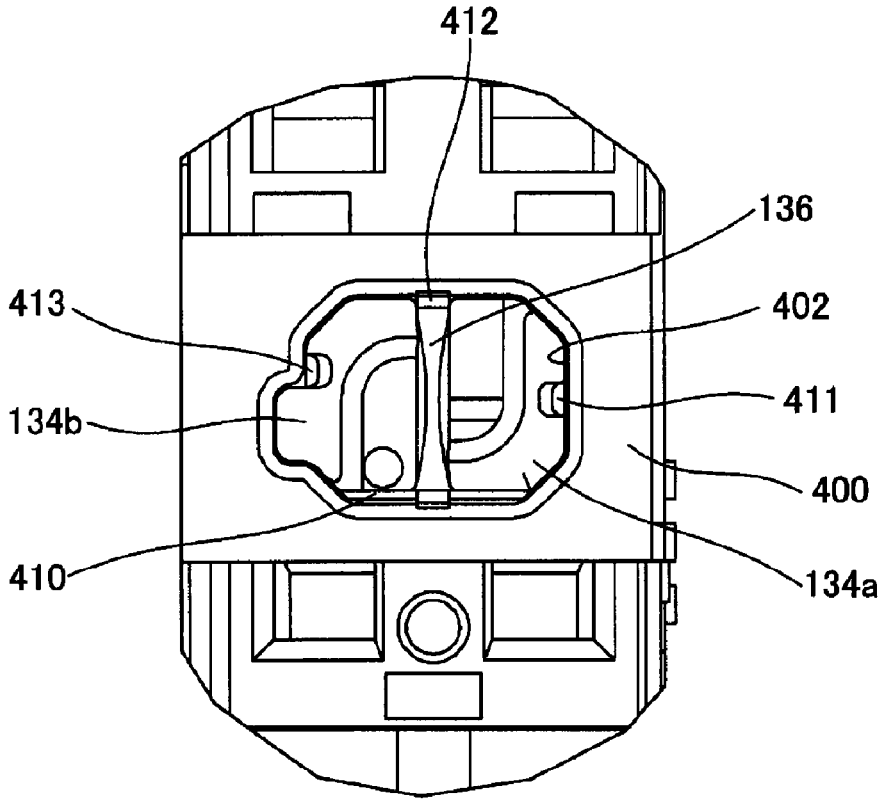
FIG. 21 is a plan view showing a casing main body 400 before installing a sensor base 210.

FIGS. 18 to 21 show specific embodiments of the embodiment shown in FIGS. 17A to 17C. FIG. 18 is a plan view showing another embodiment in the same state as in FIG. 17. FIG. 19 is a cross-sectional view along the line 19-19 in FIG. 18, and FIG. 18 is a cross-sectional view along the line 20-20 in FIG. 18. FIG. 21 is a plan view showing a casing main body 400 before installing the sensor base 210.

FIG. 18 is a plan view showing this embodiment in the same state as in FIG. 16. FIG. 19 is a cross-sectional view along the line 19-19 in FIG. 18, and FIG. 18 is a cross-sectional view along the line 20-20 in FIG. 18. FIG. 21 is a plan view showing the casing main body 400 before installing the sensor base 210.

As shown in FIG. 18, a ring-shaped welding portion 404 which is thermally welded to the film 202 (not shown) is formed around an opening 402 formed in the casing main body 400. The sensor base 210 has four sides (four sides are respectively opposite along two perpendicular axes). The sensor base 210 has four sides from the viewpoint of positioning. A shape which connects each side is not limited.

As shown in FIGS. 18 to 21, four positioning sections 410, 411, 412, and 413 which protrude toward the four sides of the sensor base 210 are provided in the opening 402 at positions opposite to the four sides of the sensor base 210. The positioning section 410 is longitudinally formed along one side (particularly long side) of the sensor base 210. The positioning sections 411 to 413 are locally provided on the remaining three sides of the sensor base 210.

The sensor base 210 is positioned in the opening 402 by setting a design tolerance for the gap D1 (omitted in FIGS. 18 to 21) between the four sides of the sensor base 210 (four sides are respectively opposite along two perpendicular axes) and the four positioning sections 410 to 413 opposite to the four sides of the sensor base 210. The sensor base 210 is effectively positioned with respect to the rotation direction by forming at least one positioning section 410 among the four positioning sections longitudinally along one side (particularly long side) of the sensor base 210. Note that it is undesirable to increase the area of the gap D1 since bubbles are produced. It suffices to form a longitudinal positioning section along only one side of the sensor base 210 from the viewpoint of limiting rotation.

An gap D2 sufficiently larger than the gap according to the above design tolerance is formed between the wall of the opening 402 and each side of the sensor base 210 in an area excluding the four positioning sections 410, 411, 412, and 413. The gap D2 forms part of the passage 134 which is formed by the upstream buffer chamber 134*a* or the downstream buffer chamber 134*b* partitioned by the partition wall 136.

The casing main body 400 is filled with ink in a state in which the inside of the casing main body 400 is approximately under vacuum. In this case, the gap D2 which communicates with the upstream buffer chamber 134*a* or the downstream buffer chamber 134*b* can function as an ink passage. Therefore, when the upstream buffer chamber 134*a* and the downstream buffer chamber 134*b* are filled with the ink, the gap D2 is also filled with the ink so that bubbles do not remain. This prevents erroneous detection of an ink end state.

The opposite positioning sections 410 and 412 among the four positioning sections are situated on the extension of the partition wall 136 (see FIG. 21) to prevent formation of an ink passage which does not pass through the sensor cavity 222.

Figure 22B:
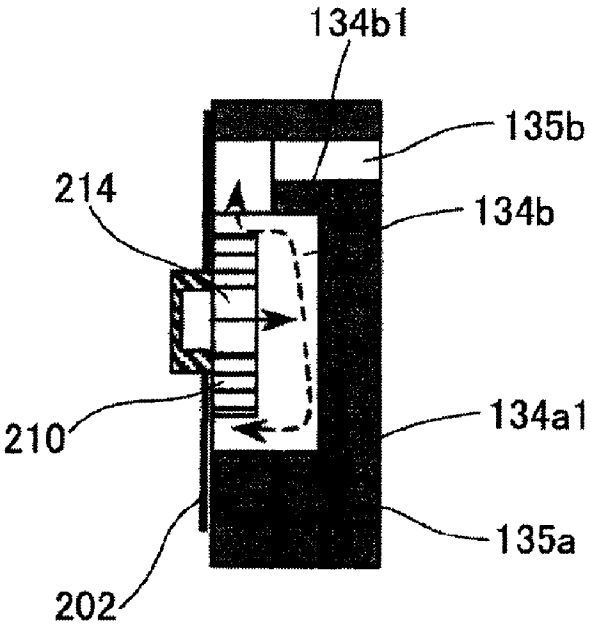
FIG. 22B is a cross-sectional view along a line 22B-22B shown in FIG. 22A.
Figure 22A:
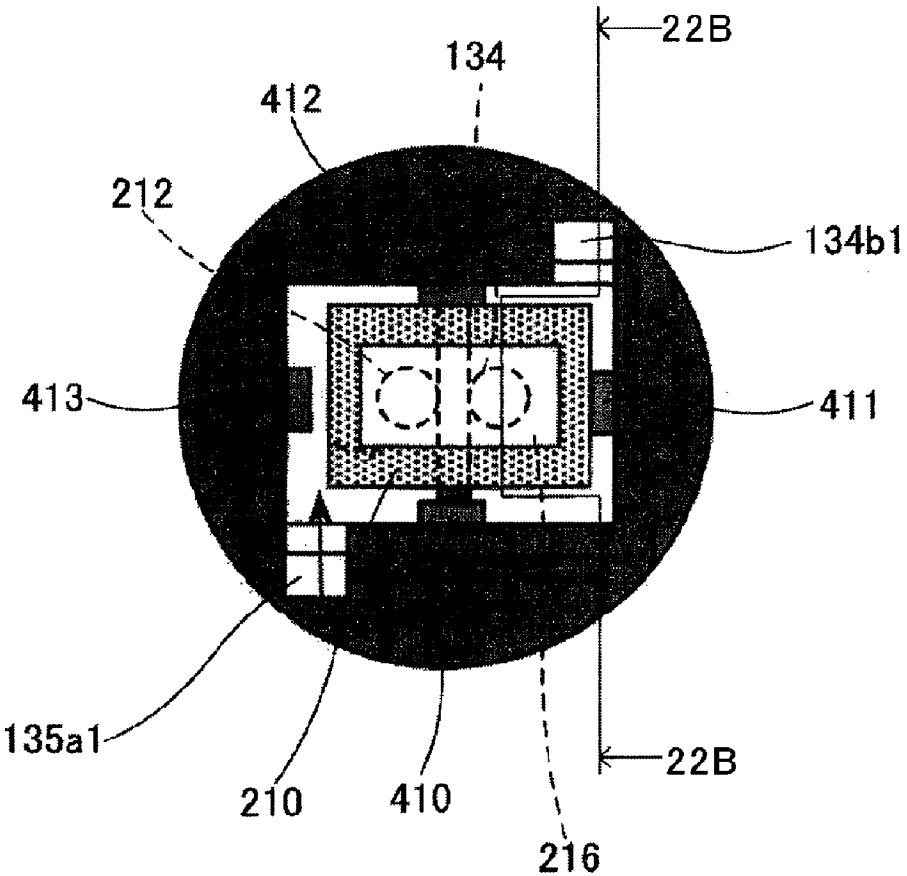
FIG. 22A is a plan view according to another embodiment showing the same state as in FIGS. 17 and 18.

In the embodiment shown in FIGS. 18 to 21, it is preferable that the supply port 135*a* of the upstream buffer chamber 134*a* is not opposite to the first hole 214 of the sensor base 210, and that the discharge port 135*b* of the downstream buffer chamber 134*b* is not opposite to the first hole 214 of the sensor base 210. The positions of the supply port 135*a* and the discharge port 135*b* may be set as shown in FIGS. 22A and 22B. FIG. 22A is a plan view according to another embodiment showing the same state as in FIG. 18A, and FIG. 22B is a cross-sectional view along the line 22B-22B in FIG. 22A.

In the embodiment shown in FIGS. 22A and 22B, the supply port 135*a* of the upstream buffer chamber 134*a* and the discharge port 135*b* of the downstream buffer chamber 134*b* are disposed at positions opposite to the gap D2 in the opening 402. In this case, it is preferable to provide a partition 134*a*1 which partitions the supply port 135*a* and the upstream buffer chamber 134*a* and a partition 134*b*1 which partitions the discharge port 135*b* and the downstream buffer chamber 134*b*.

This is because the ink introduced through the supply port 135*a* flows linearly and enters the gap D2 (preferably guided by the partition 134*a*1). Likewise, the ink discharged through the second hole 216 formed in the sensor base 210 collides against the wall of the downstream buffer chamber 134*b*, is dispersed, and enters the gap D2 (preferably guided by the partition 134*b*1).

Note that the applications of the liquid container according to the invention are not limited to an ink cartridge for an inkjet recording device. The liquid container according to the invention may also be applied to various liquid consumption devices including a liquid jet head which discharges a small amount of droplets, for example.

Specific examples of the liquid consumption device include a device including a color material jet head used to produce a color filter for a liquid crystal display or the like, a device including an electrode material (conductive paste) jet head used to form an electrode for an organic EL display, a field emission display (FED), or the like, a device including a bio-organic substance jet head used to produce a bio-chip, a device including a sample jet head as a precision pipette, a textile printing device, a microdispenser, and the like.

The liquid detection device according to the invention is not limited to a liquid detection device incorporated in an on-carriage type ink cartridge. The liquid detection device according to the invention may be incorporated in a sub-tank which is not secured to a carriage, an off-carriage type ink cartridge, and the like.

The above embodiments illustrate an example in which the casing main body of the liquid detection device is used as the casing main body of the liquid container without using a sealing rubber and a spring as disclosed in JP-A-2006-281550, for example. Note that the invention is not limited thereto. Specifically, the liquid detection device may be formed as a unit separate from the casing main body of the liquid container. In this case, a sealing rubber and a spring may be necessarily used. On the other hand, even if the size of the unit casing increases, the amplitude of the detection waveform can be increased by minimizing absorption of vibrations due to the unit casing.

In the above embodiments, the liquid jet device may be employed for a full-line type (line head) printer in which the recording head 19 has an overall shape corresponding to the length of recording paper (not shown) in the width direction (rightward/leftward direction) in the direction that intersects the transfer direction (forward/backward direction) of the recording paper.

In the above embodiments, the liquid jet device is the inkjet printer 11. Note that the invention is not limited thereto. The liquid jet device may be a liquid jet device which jets or discharges a liquid other than ink (including a fluid material in which functional material particles are dispersed or mixed in liquid and a functional material such as a gel). For example, the liquid jet device may be a liquid jet device which discharges a fluid material in which an electrode material or a color material (pixel material) used to form a liquid crystal display, an electroluminescence (EL) display, or a field emission display (FED) is dispersed or dissolved, a liquid jet device which discharges a bio-organic substance used to produce a bio-chip, or a liquid jet device which discharges a liquid as a sample used for a precision pipette. The liquid jet device may be a liquid jet device which discharges a lubricating oil to a precision instrument such as a clock or a camera in a pinpoint manner, a liquid jet device which discharges a transparent liquid resin such as a UV-curable resin onto a substrate in order to form a microhemisphere lens (optical lens) used for optical communication elements or the like, a liquid jet device which discharges an etchant such as an acid or alkali in order to etch a substrate, or a fluid material jet device which discharges a fluid material such as a gel (e.g., physical gel). The invention may be applied to one of these liquid jet devices. The term "liquid" used herein excludes a liquid which consists only of a gas. The term "liquid" includes an inorganic solvent, an organic solvent, a solution, a liquid resin, a liquid metal (metal solution), a liquid material, a fluid material, and the like.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention.

What is claimed is:

1. A liquid detection device comprising:

a casing main body, a passage being formed in the casing main body and exposed in an opening;

a sensor base that faces the passage in the opening formed in the casing main body;

a sensor chip that includes a piezoelectric element, the sensor chip being provided on the sensor base on a side that is opposite to a side that faces the passage;

a film that holds the sensor base in the opening and seals the opening; and a partition wall that divides the passage into an upstream side and an downstream side inside the casing main body, the sensor chip having a sensor cavity that receives a liquid that is a detection target;

the sensor base having a first hole that guides the liquid from the upstream side of the passage to the sensor cavity, and a second hole that guides the liquid from the sensor cavity to the downstream side of the passage; and the sensor base being configured to come into contact with the casing main body through only the partition wall at a position between the first hole and the second hole in a depth direction of the opening.

2. The liquid detection device as defined in claim 1, the casing main body including a passage wall at a position opposite to the sensor base; and the partition wall being integrally formed with the passage wall of the casing main body and extending toward the sensor base.

3. The liquid detection device as defined in claim 2, the casing main body further including an auxiliary support section that supports the sensor base at one or more positions other than the partition wall when providing the sensor base in the opening; and the auxiliary support section being apart from the sensor base when the sensor base is held by the film substantially in parallel with the passage wall.

4. The liquid detection device as defined in claim 2, the casing main body including an auxiliary support section that supports the sensor base at one or more positions other than the partition wall when providing the sensor base in the opening; and the auxiliary support section being formed to extend from the passage wall toward the sensor base, a height from the passage wall to an end of the auxiliary support section being smaller than a height from the passage wall to an end of the partition wall.

5. The liquid detection device as defined in claim 2, a flow resistance of an opening between the sensor base supported by the film and the partition wall integrally formed with the casing main body being higher than a flow resistance of the first hole.

6. The liquid detection device as defined in claim 2, an end of the partition wall being formed to be thinner than a base portion of the partition wall, and the end of the partition wall being positioned between the first hole and the second hole of the sensor base.

7. The liquid detection device as defined in claim 1, the casing main body including a passage wall at a position opposite to the sensor base; and the partition wall being integrally formed with the sensor base between the first hole and the second hole and extending toward the passage wall.

8. The liquid detection device as defined in claim 7, the sensor base including an auxiliary support section that contacts the passage wall at one or more positions other than the partition wall to support the sensor base when providing the sensor base in the opening; and the auxiliary support section being apart from the passage wall when the sensor base is held by the film substantially in parallel with the passage wall.

9. The liquid detection device as defined in claim 7, the sensor base including an auxiliary support section that contacts the passage wall at one or more positions other than the partition wall to support the sensor base when providing the sensor base in the opening; and the auxiliary support section being formed to extend from the sensor base toward the passage wall, a height from the sensor base to an end of the auxiliary support section being smaller than a height from the sensor base to an end of the partition wall.

10. The liquid detection device as defined in claim 7, a flow resistance of an opening between the partition wall of the sensor base supported by the film and the passage wall being higher than a flow resistance of the first hole.

11. The liquid detection device as defined in claim 1, the sensor base having a shape that has four sides that are respectively opposite to each other along two perpendicular axial directions;

at least four positioning sections that protrude toward the four sides of the sensor base being provided in at least the opening of the casing main body at positions opposite to the four sides of the sensor base; and a gap between a wall section that forms the opening and the four sides of the sensor base forming part of the upstream side or the downstream side of the passage in an area excluding the at least four positioning sections.

12. The liquid detection device as defined in claim 11, two of the at least four positioning sections being situated on an extension of the partition wall.

13. The liquid detection device as defined in claim 11, one of the at least four positioning sections being longitudinally formed along one side of the sensor base.

14. The liquid detection device as defined in claim 13, one of the at least four positioning sections being longitudinally formed along a long side of the sensor base.

15. The liquid detection device as defined in claim 11, a supply port that supplies a liquid to the upstream side of the passage being disposed at a position that is not opposite to the first hole of the sensor base, and a discharge port that discharges a liquid from the downstream side of the passage being disposed at a position that is not opposite to the second hole of the sensor base.

16. The liquid detection device as defined in claim 15, the supply port that supplies the liquid to the upstream side of the passage and the discharge port that discharges the liquid from the downstream side of the passage being disposed opposite to the opening in an area excluding the at least four positioning sections.

17. A method of producing a liquid detection device comprising:

a disposing operation which disposes a sensor base provided with a sensor chip that includes a piezoelectric element to face a passage in an opening formed in a casing main body; and a welding operation which welds a film around the opening so that the sensor base is supported by the casing main body through the film and the opening is sealed, wherein the disposing operation includes a supporting operation which supports the sensor base by a partition wall that partitions the passage into an upstream side and a downstream side in the casing main body;

wherein the sensor base is supported only by the partition wall in the disposing operation before the welding operation; and wherein the disposing operation and the welding operation causes a sensor cavity to communicate with the upstream side of the passage through a first hole formed in the sensor base and communicate with the downstream side of the passage through a second hole formed in the sensor base to form a liquid detection path.

18. The method of producing a liquid detection device as defined in claim 17, the sensor base being supported by the partition wall and an auxiliary support section in the disposing operation; and the auxiliary support section being apart from the sensor base in the welding operation.

* * * * *